US006576383B2

(12) United States Patent
Yang

(10) Patent No.: US 6,576,383 B2
(45) Date of Patent: Jun. 10, 2003

(54) METHOD OF MANUFACTURING A LUMINESCENT SCREEN FOR A CRT

(75) Inventor: Liyou Yang, Plainsboro, NJ (US)

(73) Assignee: Thomson Licensing S.A., Boulogne Cedex (FR)

( * ) Notice: Subject to any disclaimer, the term of this patent is extended or adjusted under 35 U.S.C. 154(b) by 20 days.

(21) Appl. No.: 10/040,112

(22) Filed: Nov. 9, 2001

(65) Prior Publication Data

US 2003/0091915 A1 May 15, 2003

(51) Int. Cl.[7] ..... H01J 9/227
(52) U.S. Cl. ..... 430/24; 430/25
(58) Field of Search ..... 430/23, 24, 25, 430/31

(56) References Cited

U.S. PATENT DOCUMENTS 5,902,708 A * 5/1999 Gorog et al. ..... 430/28
6,013,400 A * 1/2000 LaPeruta et al. ..... 430/24

* cited by examiner

*Primary Examiner*—John A. McPherson
(74) *Attorney, Agent, or Firm*—Joseph S. Tripoli; Joseph J. Laks; Carlos M. Herrera

(57) ABSTRACT

A method of manufacturing a luminescent screen assembly for a color cathode-ray tube (CRT) is disclosed. The luminescent screen assembly is formed on an inner surface of a faceplate panel of the CRT. The luminescent screen assembly includes an organic conductive (OC) layer overcoated with an organic photoconductive (OPC) layer. Three different color-emitting phosphors are sequentially deposited over portions of the OPC layer by uniformly charging and than selectively discharging desired areas thereof. Appropriate color-emitting phosphors are then deposited on the discharged areas. The first color-emitting phosphor lines are deposited on the OPC layer by charging and then selectively discharging the OPC layer using a symmetric exposure profile. Thereafter, the OPC layer is charged again and selectively discharged to deposit the second color-emitting phosphor lines using an asymmetric exposure profile. The asymmetric exposure profile is generated using two or more lighthouse exposures that are asymmetrically positioned relative to the midpoint location of the second color-emitting phosphor lines. Thereafter, the OPC layer is again charged and selectively discharged to deposit the third color phosphor lines using a symmetric exposure profile.

8 Claims, 7 Drawing Sheets

METHOD OF MANUFACTURING A LUMINESCENT SCREEN FOR A CRT

BACKGROUND OF THE INVENTION

1. Field of the Invention

The invention relates to a color cathode-ray tube (CRT) and, more particularly to a method of manufacturing a luminescent screen assembly for a color cathode-ray tube.

2. Description of the Background Art

A color cathode-ray tube (CRT) typically includes an electron gun, an aperture mask, and a screen. The aperture mask is interposed between the electron gun and the screen. The screen is located on an inner surface of a faceplate of the CRT. The aperture mask functions to direct electron beams generated in the electron gun toward appropriate color-emitting phosphors on the screen of the CRT.

The screen may be a luminescent screen. Luminescent screens typically comprise an array of three different color-emitting phosphors (e.g., green, blue, and red). Each color-emitting phosphor is separated one from the other by a matrix line. The matrix lines are typically formed of a light-absorbing black inert material.

Luminescent screens may be formed using an electrophotographic screening (EPS) process. In EPS processes, an organic photoconductive (OPC) layer is sprayed over an organic conductive (OC) layer, formed on an interior surface of a faceplate panel having matrix lines formed thereon. The three different color-emitting phosphors are than sequentially deposited on portions of the OPC layer. Each of the three different color-emitting phosphors is sequentially deposited by first uniformly charging the OPC layer and then selectively discharging portions thereof. Appropriate charged color-phosphors are then deposited on the discharged portions of the OPC layer.

However, after the first color-emitting phosphor lines are deposited on the OPC layer, the phosphor-deposited portions of the OPC layer have a higher electrostatic potential than the bare OPC portions. When the OPC is selectively charged and discharged to deposit the second color-emitting phosphor lines, this higher electrostatic potential causes the deposition of the second color phosphor lines to be misaligned with respect to the deposition of the first color-emitting phosphor lines.

Accordingly, a new method for forming the color phosphors on a luminescent screen is required.

SUMMARY OF THE INVENTION

The present invention relates to a method of manufacturing a luminescent screen assembly for a color cathode-ray tube (CRT). The luminescent screen assembly is formed on an inner surface of a faceplate panel of the CRT. The luminescent screen assembly includes an organic conductive (OC) layer over-coated with an organic photoconductive (OPC) layer. Three different color-emitting phosphors are sequentially deposited over portions of the OPC layer by uniformly charging and than selectively discharging desired areas thereof. Appropriate coloremitting phosphors are then deposited on the discharged areas. The first coloremitting phosphor lines are deposited on the OPC layer by charging and then selectively discharging the OPC layer using a symmetric exposure profile. Thereafter, the OPC layer is charged again and selectively discharged to deposit the second color-emitting phosphor lines using an asymmetric exposure profile. The asymmetric exposure profile is generated using two or more lighthouse exposures that are asymmetrically positioned relative to the midpoint location of the second coloremitting phosphor lines. The asymmetric exposure profile for the second color phosphor lines minimizes any misalignment of the second color-emitting phosphor lines with respect to the first color-emitting phosphor lines. Thereafter, the OPC layer is again charged and selectively discharged to deposit the third color phosphor lines using a symmetric exposure profile.

BRIEF DESCRIPTION OF THE DRAWINGS

The invention will now be described in greater detail, with relation to the accompanying drawings, in which.

DETAILED DESCRIPTION OF THE INVENTION

Figure 1:
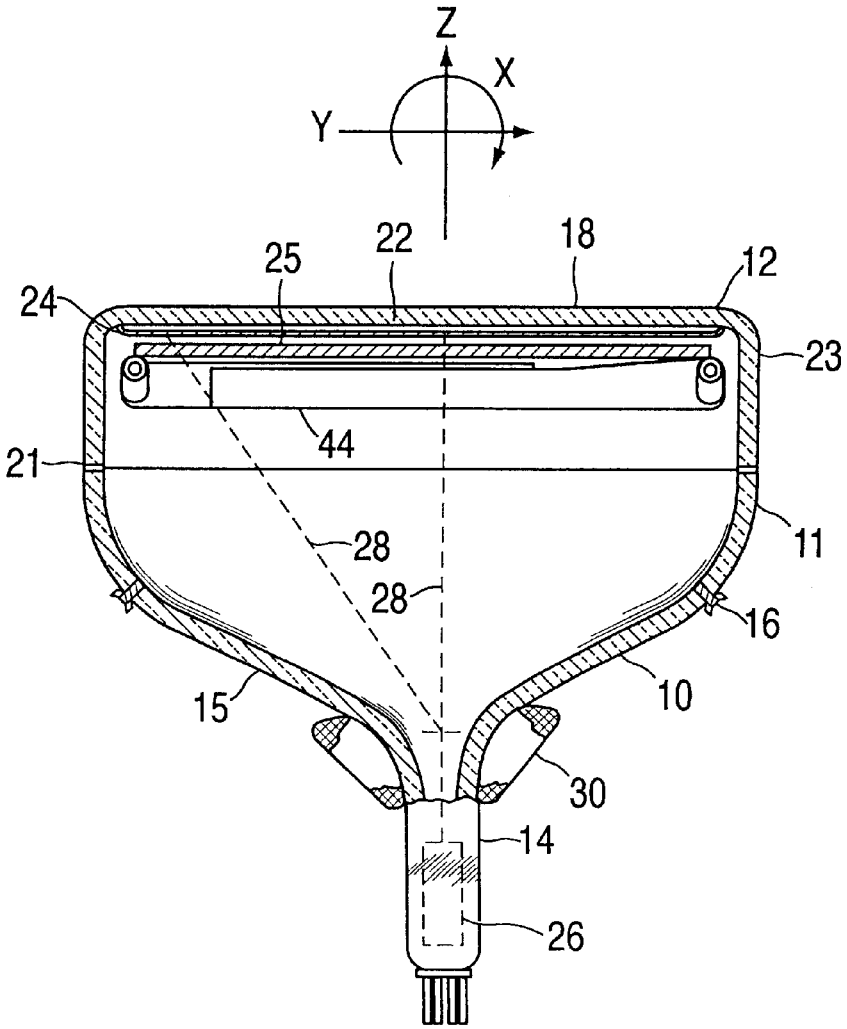
FIG. 1 is a plan view, partly in axial section, of a color cathode-ray tube (CRT) made according to the present invention.

FIG. 1 shows a color cathode-ray tube (CRT) 10 having a glass envelope 11 comprising a faceplate panel 12 and a tubular neck 14 connected by a funnel 15. The funnel 15 has an internal conductive coating (not shown) that is in contact with, and extends from, an anode button 16 to the neck 14.

Figure 8:
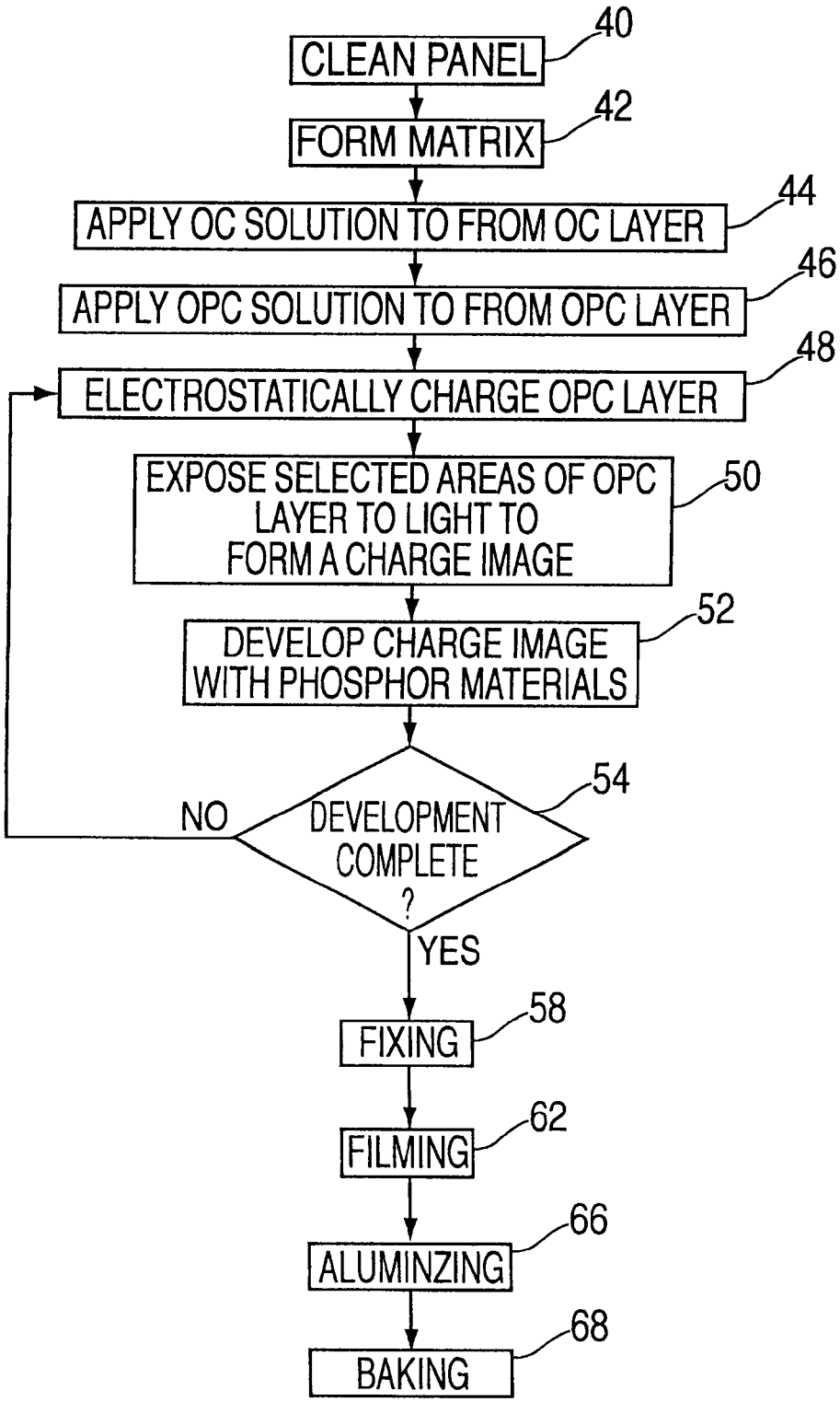
FIG. 8 is a block diagram comprising a flow chart of the manufacturing process for the screen assembly.

The faceplate panel 12 comprises a viewing faceplate 18 and a peripheral flange or sidewall 23 that is sealed to the funnel 15 by a glass frit 21. A three-color luminescent phosphor screen 22 is carried on the inner surface of the faceplate 18. The screen 22, shown best in FIG. 8, is a line screen which includes a multiplicity of screen elements comprising red-emitting, green-emitting, and blue-emitting phosphor stripes R, G, and B, respectively, arranged in color groups or picture elements of three stripes or triads, in a cyclic order with each triad including a phosphor line of each of the three colors. The R, G, B, phosphor stripes extend in a direction that is generally normal to the plane in which the electron beams are generated.

A light-absorbing matrix 20, separates the phosphor lines. A thin conductive aluminum layer 24, overlies the screen 22 and provides means for applying a uniform first anode potential to the screen 22, as well as for reflecting light, emitted from the phosphor elements, through the faceplate 18. The screen 22 and the overlying aluminum layer 24 comprise a screen assembly.

A multi-aperture color selection electrode, or shadow mask 25 (Shown in FIG. 1), is removably mounted, by conventional means, within the face predetermined spaced relation to the screen assembly 22.

An electron gun 26, shown schematically by the dashed lines in FIG. 1, is centrally mounted within the neck 14, to generate and direct three inline electron beams 28, a center and two side or outer beams, along convergent paths through the shadow mask 25 to the screen 22. The inline direction of the center beam 28 is approximately normal to the plane of the paper.

The CRT of FIG. 1 is designed to be used with an external magnetic deflection yoke, such as the yoke 30, shown in the neighborhood of the funnel-to-neck junction. When activated, the yoke 30 subjects the three electron beams 28 to magnetic fields that cause the beams to scan a horizontal and vertical rectangular raster across the screen 22.

Figure 7:
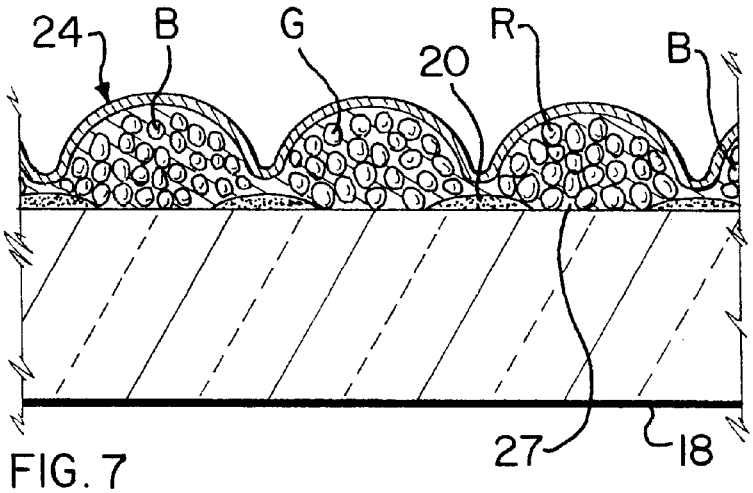
FIG. 7 is a section of a faceplate panel portion of the CRT of FIG. 1, after screen bake showing the three phosphor deposits and the aluminum layer.

The screen 22 is manufactured using an electrophotographic screening (EPS) process that is shown schematically in FIG. 7. Initially, the panel 12 is cleaned, as indicated by reference numeral 40, by washing with a caustic solution, rinsing with water, etching with buffered hydrofluoric acid (HF) and rinsing again with water, as is known in the art. The interior surface of the viewing faceplate 18 is then provided with the light-absorbing matrix 20, as indicated by reference numeral 42, preferably using a wet matrix process, as is known in the art. The light-absorbing matrix 20 is a series of substantially parallel lines having spaces therebetween referred to as openings 27. For a faceplate panel 12 having a diagonal dimension of about 68 cm (27 inches), the openings 27 formed in the layer of light-absorbing matrix 20 have widths in a range of about 0.075 mm to about 0.25 mm, and the opaque matrix lines have widths in a range of about 0.075 mm to about 0.30 mm.

Figure 2A:
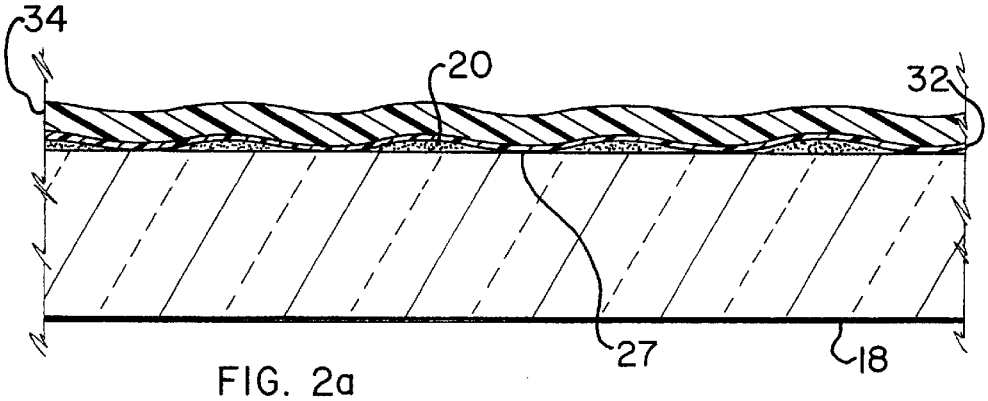
FIGS. 2*a*–2*b* is a section of a faceplate panel portion of the CRT of FIG. 1, showing the matrix, organic conductive layer and organic photoconductive layer, before and after corona charging.

Referring to FIG. 2*a* and step 44 of FIG. 8 which represents the application of an organic conductive layer 32, the interior surface of the viewing faceplate 18, having a matrix 20 thereon, is then coated with a suitable layer of a volatilizable, organic conductive (OC) material 32. Suitable materials for the OC layer 32 include quaternary ammonium polyelectrolytes such as, for example, poly(dimethyl-diallylammonium chloride), poly(3,4-dimethylene-N-dimethylpyrrolidium chloride), DNDP chloride), poly(3,4-dimethylene-N-dimethyl-pyrrolidium nitrate), and poly(3,4-dimethylene-N-dimethethyl-pyrrolidium phosphate)(3,4-DNDP phosphate). Altematively, 3,4-polyethylenedioxythiophene-polystyrenesulfonate (cationic) or vinylimidazolium methosulfate (VIM) vinylpyrrolidone (VP) copolymer may be used. The OC layer 32 typically has a thickness within a range of about 0.5 microns to about 2 microns.

An organic photoconductive (OPC) layer 34 is formed over the OC layer 32, as also shown in FIG. 2*a* and indicated in step 46. The OPC layer 34 is formed by overcoating the OC layer 32 with an OPC solution containing a polystyrene resin, an electron donor material, such as 1,4-di(2,4-methyl phenyl)-1,4-diphenylbutatriene (2,4-DMPBT), electron acceptor materials, such as 2,4,7-trinitro-9-fluorenone (TNF) and 2-ethylanthroquinone (2-EAQ), and a suitable solvent, such as toluene, xylene, or a mixture of toluene and xylene. A surfactant, such as silicone U-7602, and a plasticizer, such as dioctyl phthalate (DOP), may also be added to the OPC solution. The surfactant U-7602 is commercially available from Union Carbide, Danbury,Conn.

The composition of the OPC solution preferably comprises about 4.8% by weight to about 7.2% by weight of the polystyrene resin, about 0.8% by weight to about 1.3% by weight of the electron donor material (2,4-DMBPT), about 0.04% by weight to about 0.06% by weight of TNF and about 0.12% by weight to about 0.36% by weight of 2-EAQ, as electron acceptor materials, about 0.3% by weight of a plasticizer (DOP), about 0.01% by weight of a surfactant (silicone U-7602), and the balance comprising a mixture of toluene and xylene. The toluene concentration in the OPC solution is preferably within a range of about 18% by weight to about 75% by weight and the xylene concentration is preferably within a range of about 18% by weight to about 75% by weight. The total solid content of the OPC solution should be within a range of about 6% by weight to about 9% by weight, and preferably within a range of about 7% by weight to about 8% by weight.

The OPC solution may be applied over the OC layer 32 using electrostatic spray guns (not shown). Suitable electrostatic spray guns include AEROBELL™ model electrostatic spray guns commercially available from ITW Ransburg, Toledo, Ohio.

The electrostatic spray guns provide an aerosol of negatively charged droplets of the OPC solution on the OC layer 32. The OC layer 32 is grounded during the electrostatic spraying operation, in order to attract the negatively charged droplets of the OPC solution toward the more electrically positive OC layer 32.

Figure 2B:
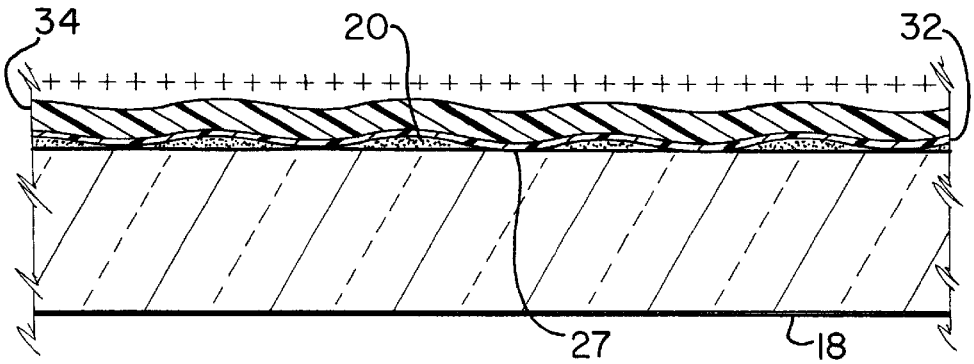
Figure 3:
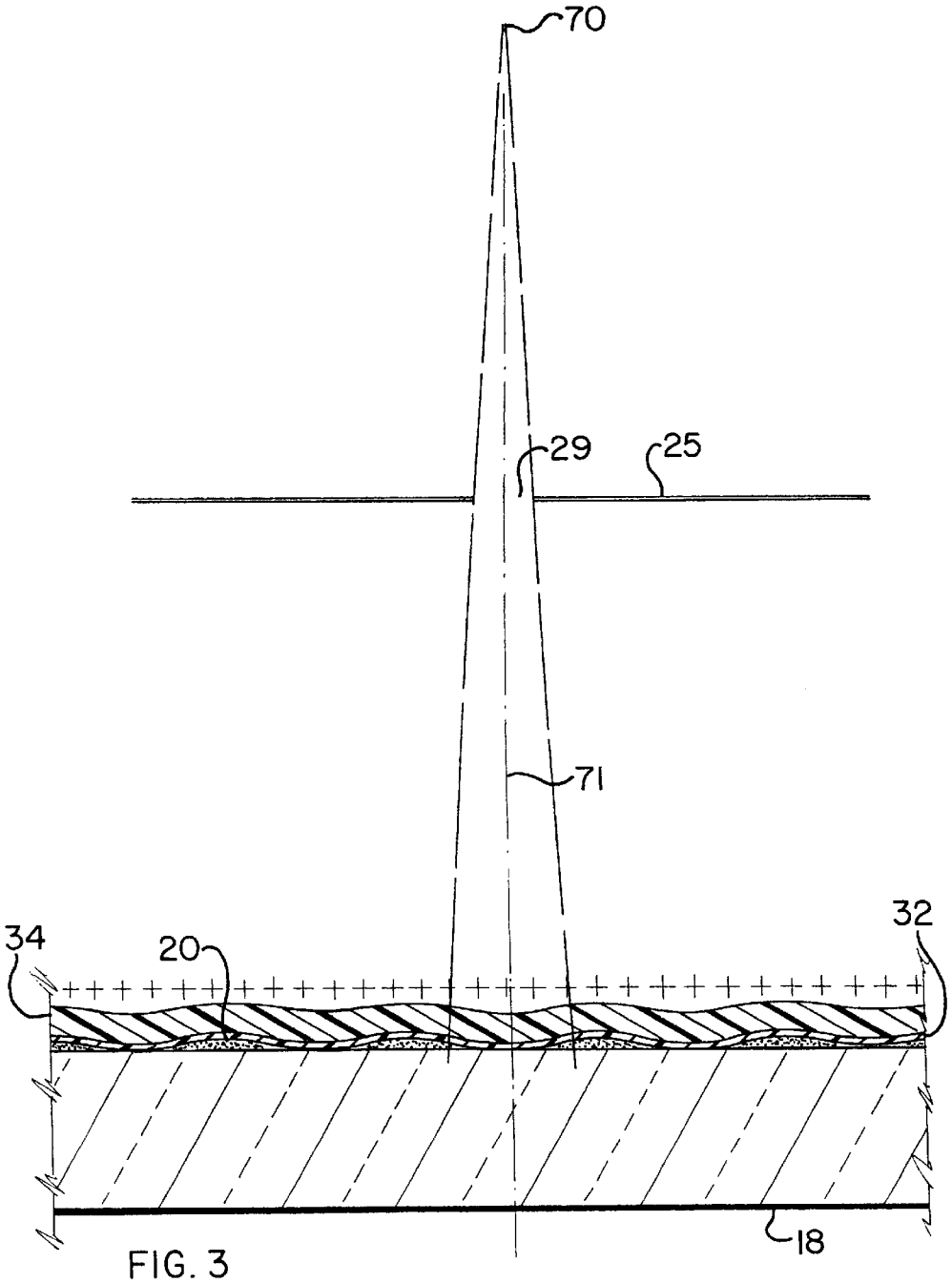
FIG. 3 is a pictorial representation of the symmetric exposure for preparation of the first color phosphor.
Figure 4A:
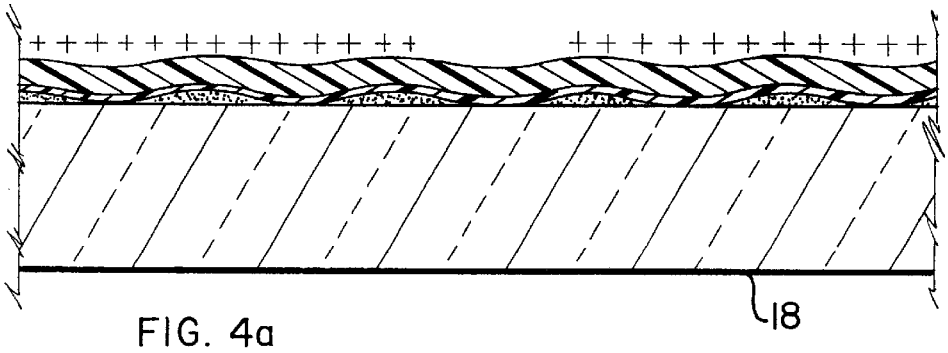
FIGS. 4*a*–4*b* a section of a faceplate panel portion of the CRT of FIG. 1, showing the matrix, organic conductive layer and organic photoconductive layer, after the first exposure and after the deposition of the first color phosphor.

After the OPC layer 34 is applied, it is uniformly electrostatically charged, as indicated by reference numeral 48, using a corona discharge device (not shown). FIG. 2*b* represents the OPC layer 34 when charged. The OPC layer 34 is typically charged to have a voltage within a range of about +200 volts to about +700 volts. Thereafter, the shadow mask 25 is reinserted into the faceplate panel 12, placed in a lighthouse, and exposed, through the shadow mask, to light from a suitable light source disposed within the lighthouse, which is represented in FIG. 3, wherein the mask 25 has apertures 29 through which the light from a first source position 70 is irradiated. The center of symmetry for the first color deposit is represented by a first color symmetry line 71. An equally effective first color exposure for the printing of the first color phosphor, which also maintains symmetry is to use two separate source positions which are at equal but opposite directions from the first source position 70. In either case, it is important that central portion of the light energy profile propagates through the apertures 29 in the shadow mask 25, at angles identical to those of the electron beams from the electron gun of the tube, discharging the illuminated first phosphor areas on the OPC layer 34 so as to form charge images, as indicated by reference numeral 50. FIG. 4*a* demonstrates the electrostatic charge image after the first exposure step.

Figure 4B:
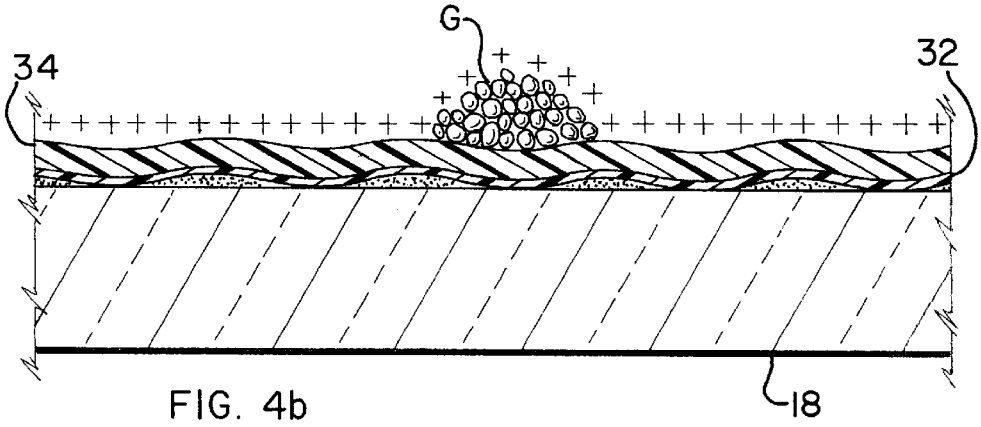

After the shadow mask 25 is removed from the faceplate panel 12, the panel is placed onto a first phosphor developer, containing first color-emitting phosphor material, to develop the charge image, as indicated by reference numeral 52. The first color-emitting phosphor material is positively triboelectrically-charged within the developer and directed toward the OPC layer 34. The positively charged first coloremitting phosphor material is repelled by the positively charged areas on the OPC layer 34 and deposited onto the discharged areas thereof by the process known in the art as "reversal" development. In reversal development, triboelectrically-charged particles of phosphor material are repelled by similarly charged areas of the OPC layer 34 and deposited onto the discharged areas thereof. The first color deposit is aligned with its targets matrix opening 27 as shown in FIG. 4*b*.

The size of each of the first color-emitting phosphor elements is slightly larger than the size of the openings 27 to provide complete coverage of each opening 27 and a slight overlap on the matrix material surrounding the openings 27. Since three different color-emitting phosphors are required to form the screen 22, the light exposure step 50 and the phosphor development step 52 are repeated for each of the other two color-emitting phosphors.

Figure 5:
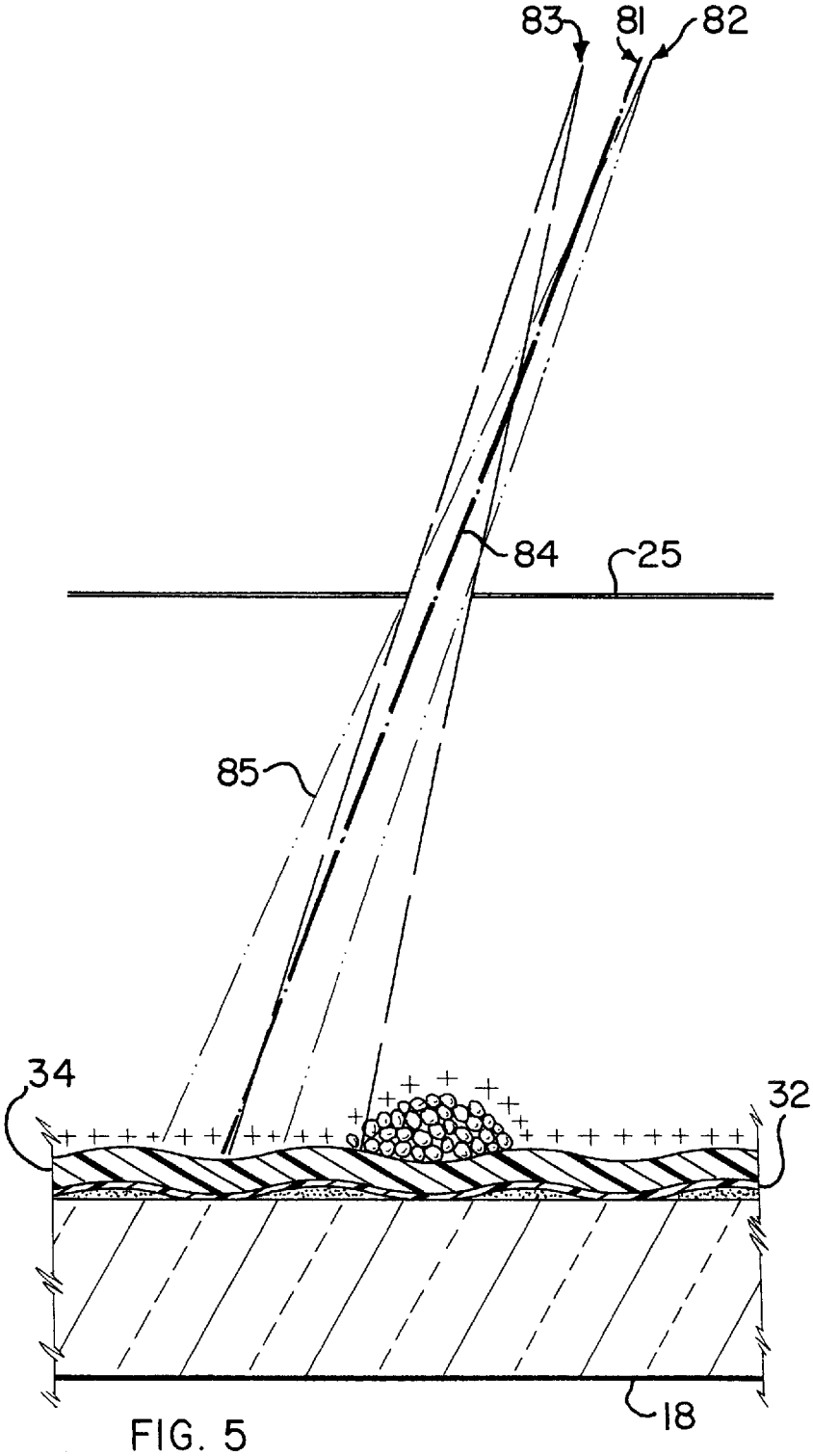
FIG. 5 is a pictorial representation of the asymmetric exposure for preparation of the second color phosphor.
Figure 6A:
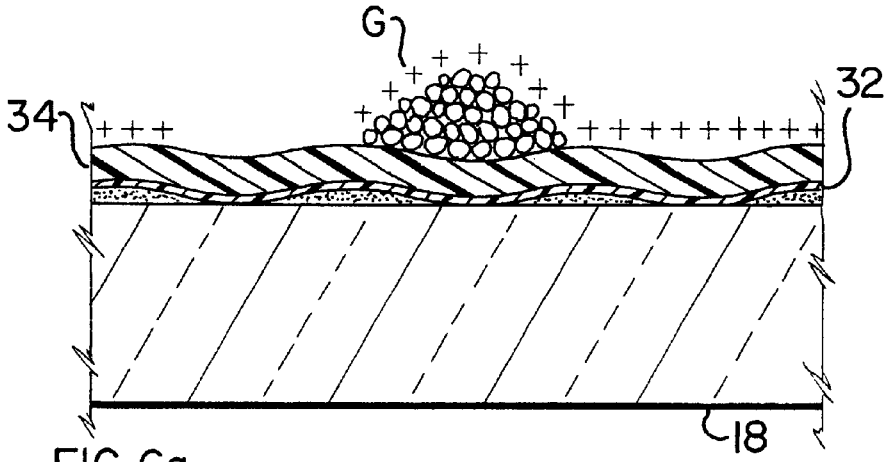
FIGS. 6*a*–6*b* a section of a faceplate panel portion of the CRT of FIG. 1, showing the matrix, organic conductive layer and organic photoconductive layer, after the second exposure and after the deposition of the second color phosphor.
Figure 6B:
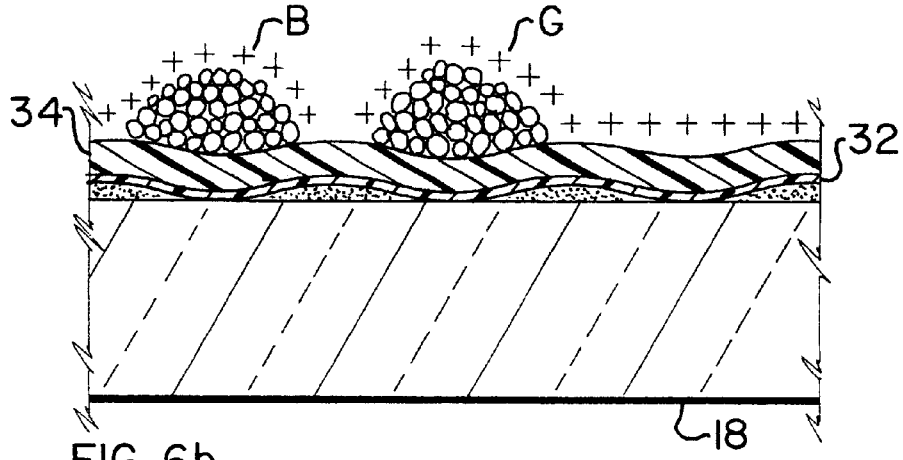

The second color-emitting phosphor lines are deposited by selectively discharging portions of the OPC layer using a cumulative asymmetric exposure profile, wherein cumulative refers resultant energy distribution applied to the screen from each of the exposures used to discharge the OPC layer in preparation for the second color-emitting phosphor lines. (All references to exposure profiles are intended to be cumulative with respect to symmetric or asymmetric profiles.) The asymmetric exposure profile is generated using two or more lighthouse exposures that are asymmetrically positioned relative to the midpoint location of the second color-emitting phosphor lines. This midpoint location is the targeted center position of second color's matrix opening 27. The asymmetrically positioned lighthouse exposures provide a spatial dissipation of the photon flux that effectively extends the light source onto the first color-emitting phosphor lines, so as to discharge a portion of the OPC layer along the first color-emitting phosphor lines. Discharging a portion of the first color-emitting phosphor lines reduces the electrostatic potential near the second color-emitting phosphor lines, thereby minimizing misalignment of the second color-emitting phosphor lines with respect to the first color-emitting phosphor lines. This is necessary because it further reduces the electrostatic charge of the OPC layer 34 near the first phosphor color and potentially under it. The issue is that the first color phosphor particles still retain electrostatic charge even when irradiated with the light source. FIG. 5 demonstrates this asymmetric exposure process. A second color symmetry line 84, which runs from the theoretical second color source position 81 to the targeted center position of second color's matrix opening 27, corresponds to angles identical to those of the electron beam from the respective electron gun of the tube 10. A first source position 82 and the second source position 83 are asymmetric about the theoretical second color source position 81. The light emitted from the first source position 82 has profile edge regarded as a natural boundary 85, which essentially dictates where one edge of the second color deposit will terminate and, as such, the first source position 82 is a predetermined value and is preferably kept stationary. On the other hand, the second source position 83 is adjusted to provide the proper asymmetric exposure profile to counterbalance the electrostatic potential near the second color-emitting phosphor lines which would otherwise cause the second color deposits to be misaligned their respective matrix opening 27. FIGS. 6*a*–6*b* represent the interior surface of the faceplate 18 just before and after the deposition of the second color deposit.

Thereafter, the third color-emitting phosphor lines are deposited on the OPC layer 34 by selectively discharging portions thereof again using a symmetric exposure profile.

After the three color-emitting phosphors are deposited on the OPC layer 34, they are fixed and filmed, as indicated by steps 58 and 62 in FIG. 8, to provide a smooth surface over the screen onto which an evaporated aluminum layer 24 can be deposited. Suitable fixative compositions comprise mixtures of solvents such as methyl isobutyl ketone (MIBK) and d-limonene. Suitable filming compositions may comprise acrylic polymers such as butyl methacrylate and polymethylmethacrylate.

After fixing and filming the three color-emitting phosphors on the OPC layer 34, the screen 22 is aluminized and then baked at a temperature of above 425° C. for about 30 minutes, to drive-off the volitilizable constituents remaining on such screen 22 (e. g., the OC layer, the OPC layer, and the filming layer). FIG. 7 represents the screen structure on the interior of the faceplate 18 after baking.

As the embodiments that incorporate the teachings of the present invention have been shown and described in detail, those skilled in the art can devise other varied embodiments that incorporate these teachings without departing from the spirit of the invention. One such other embodiment includes generating a constructive asymmetric exposure for the printing of the second color phosphor by actually having the first source position 82 and second source position 83 at symmetric positions about the theoretical second color source position 81, however, the asymmetry is generated by having the energy of the light source from the second source position 83 exceed that of first source position 82. In addition, other embodiments include cases where the green or red phosphor deposits serve as the second color deposit as opposed to what is illustrated in the figures and instances where the asymmetric exposure profile is generated from asymmetric source locations having light generated from specific source locations having equal energy or unequal energy.

What is claimed is:

1. A method of manufacturing a luminescent screen assembly for a color cathode-ray tube (CRT), comprising:

providing a faceplate panel, wherein the faceplate panel has a light absorbing matrix thereon;

applying an organic conductive (OC) layer on the panel having the light-absorbing matrix;

applying an organic photoconductive (OPC) layer on the organic conductive (OC) layer;

electrically charging the organic photoconductive (OPC) layer;

sequentially discharging selected portions of the electrically charged organic photoconductive (OPC) layer using a symmetric exposure profile and an asymmetric exposure profile, wherein the asymmetric exposure profile is generated by exposing the OPC layer at a plurality of light source positions that are asymmetrical with respect to a midpoint location of a color-emitting phosphor line; and affixing a color-emitting phosphor onto the discharged portions of the organic photoconductive (OPC) layer after each exposure step.

2. The method of claim 1 wherein the step of sequentially discharging selected portions of the OPC layer using the symmetric exposure profile comprises:

exposing the OPC at a plurality of light source positions that are symmetrical with respect to a midpoint location of a color-emitting phosphor line.

3. A method of manufacturing a luminescent screen assembly for a color CRT on an interior surface of a viewing faceplate of a panel comprising the steps of:

coating said interior surface of said viewing faceplate to form a volatilizable organic conductive (OC) layer;

overcoating said OC layer to form a volatilizable organic photoconductive (OPC) layer;

electrostatically charging said OPC layer;

symmetrically exposing selected areas of said OPC layer to light with a cumulative symmetric profile to form a first discharged portion;

affixing a triboelectrically charged color-emitting phosphor onto said first discharged portion to form a first color-emitting phosphor line;

electrostatically charging said OPC layer;

exposing selected areas of said OPC layer to light with a cumulative asymmetric exposure profile to form a second discharged portion, wherein said second discharge portion extends toward the first color-emitting phosphor line;

affixing a triboelectrically charged color-emitting phosphor onto said second discharged portion to form a second color-emitting phosphor line;

electrostatically charging said OPC layer;

exposing said OPC layer to light to form a third discharged portion; and, affixing a triboelectrically charged color-emitting phosphor onto said third discharged portion to form a luminescent screen comprising picture elements of triads of color-emitting phosphors.

4. The method of claim 3 wherein said second discharge portion extends into the portion of said first color-emitting phosphor line.

5. The method of claim 3 wherein the step of sequentially discharging selected portions of the OPC layer using the symmetric exposure profile comprises:

exposing the OPC at a plurality of light source positions that are symmetrical with respect to a midpoint location of a color-emitting phosphor line.

6. The method of claim 3 wherein the cumulative asymmetric exposure profile comprises:

exposing the OPC to a plurality of light source positions that are asymmetrical with respect to a midpoint location of a color-emitting phosphor line.

7. The method of claim 3 wherein the cumulative asymmetric exposure profile comprises:

exposing the OPC to a plurality of light source positions that are symmetrical with respect to a midpoint location of a color-emitting phosphor line, wherein light from at least one of the plurality of light source positions is greater in energy than light from at least one other of the plurality of light source positions.

8. The method of claim 3 wherein the cumulative asymmetric exposure profile comprises:

exposing the OPC to a plurality of light source positions wherein light from a predetermined position provides a natural boundary defining a predetermined edge of a second color-emitting phosphor line, said predetermined edge is on the side opposite to the first color-emitting phosphor line.

* * * * *